US007717165B2

(12) United States Patent
Hendrix et al.

(10) Patent No.: US 7,717,165 B2
(45) Date of Patent: May 18, 2010

(54) HEAT EXCHANGER, ESPECIALLY CHARGE-AIR/COOLANT RADIATOR

(75) Inventors: Daniel Hendrix, Stuttgart (DE); Florian Moldovan, Stuttgart (DE); Jürgen Wegner, Eislingen/Fils (DE)

(73) Assignee: BEHR GmbH & Co. KG, Stuttgart (DE)

( * ) Notice: Subject to any disclaimer, the term of this patent is extended or adjusted under 35 U.S.C. 154(b) by 345 days.

(21) Appl. No.: 10/579,039

(22) PCT Filed: Nov. 10, 2004

(86) PCT No.: PCT/EP2004/012719

§ 371 (c)(1),
(2), (4) Date: May 10, 2006

(87) PCT Pub. No.: WO2005/045344

PCT Pub. Date: May 19, 2005

(65) Prior Publication Data

US 2007/0084592 A1 Apr. 19, 2007

(30) Foreign Application Priority Data

Nov. 10, 2003 (DE) ..... 103 52 881

(51) Int. Cl.
*F28F 3/08* (2006.01)

(52) U.S. Cl. ..... 165/167; 165/170

(58) Field of Classification Search ..... 165/166, 165/167, 170

See application file for complete search history.

(56) References Cited

U.S. PATENT DOCUMENTS 3,862,661 A 1/1975 Kovalenko et al.
4,230,179 A 10/1980 Uehara et al.
4,572,766 A * 2/1986 Dimitriou ..... 165/167
5,174,370 A 12/1992 Hallgren
5,230,406 A 7/1993 Poon
5,230,966 A * 7/1993 Voss et al. ..... 429/26
5,931,219 A 8/1999 Kull et al.
6,170,568 B1 1/2001 Valenzuela
6,293,337 B1 9/2001 Strahle et al.
6,305,466 B1 10/2001 Anderson et al.
6,389,696 B1 5/2002 Heil et al.
6,681,846 B2 1/2004 Angermann et al.

(Continued)

FOREIGN PATENT DOCUMENTS

CN 245491 A 11/1946

(Continued)

OTHER PUBLICATIONS

D. Hendrix et al., U.S. PTO Office Action, U.S. Appl. No. 10/579,037; dated Jan. 28, 2008, 9 pages.

(Continued)

*Primary Examiner*—Teresa J Walberg
(74) *Attorney, Agent, or Firm*—Foley & Lardner LLP

(57) ABSTRACT

Disclosed is a heat exchanger, particularly a charge-air/coolant radiator (1), having a disk-type structure. Said heat exchanger comprises a plurality of disks (2) which are penetrated by a coolant and a fluid that is to be cooled. The inlet zone and/or outlet zone for the fluid that is to be cooled is/are expanded at least at the discharge end or delivery end.

15 Claims, 3 Drawing Sheets

U.S. PATENT DOCUMENTS

Figure 1:
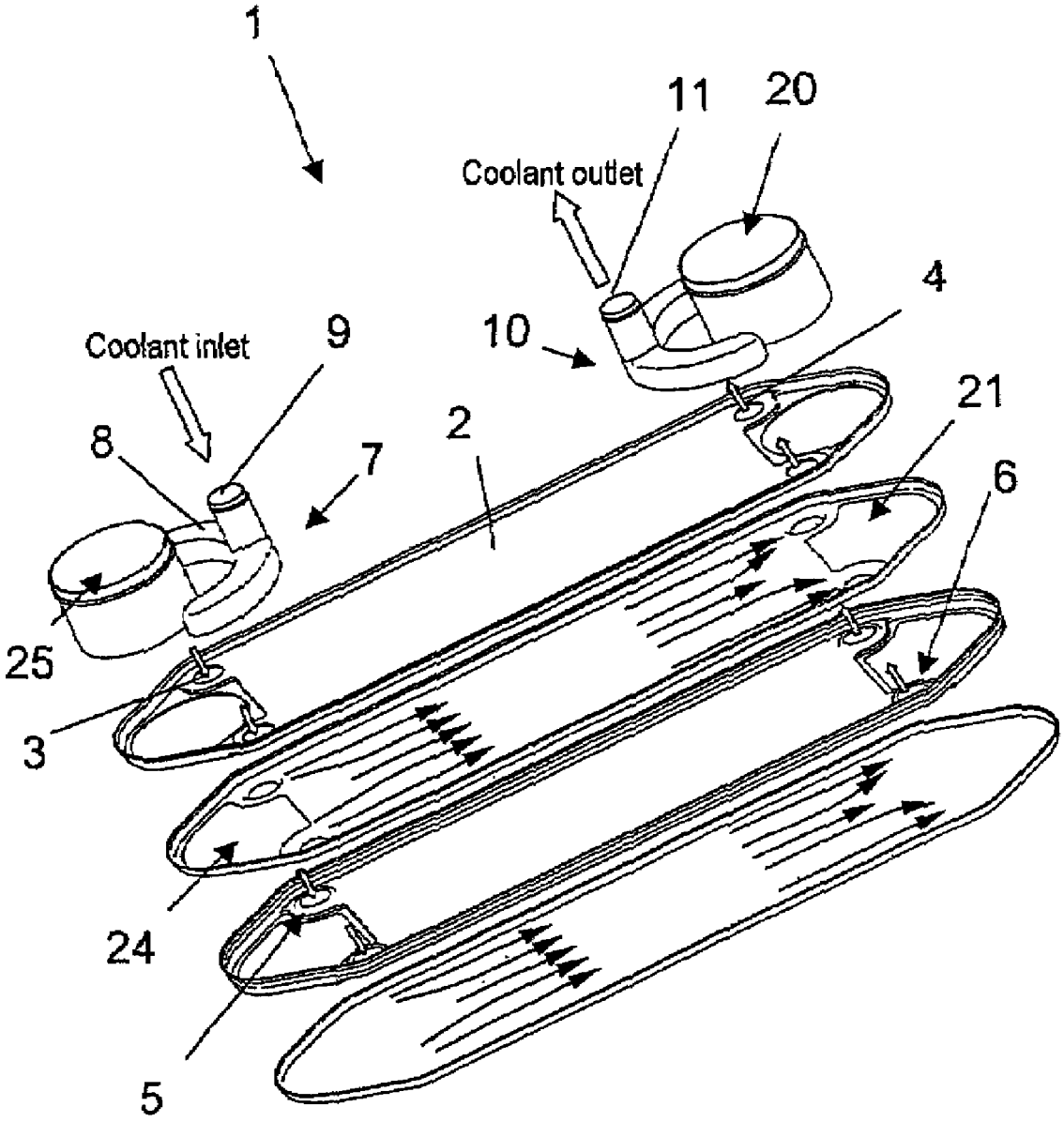

| | | | | |
|---|---|---|---|---|
| 6,823,934 | B2 | 11/2004 | Anderson | |
| 2002/0000310 | A1 | 1/2002 | Cheadle | |
| 2003/0047303 | A1 * | 3/2003 | Andersson | 165/167 |
| 2003/0098146 | A1 | 5/2003 | Angermann et al. | |
| 2004/0067414 | A1 | 4/2004 | Wei et al. | |
| 2004/0206488 | A1 | 10/2004 | Ikuta | |
| 2007/0131402 | A1 | 6/2007 | Hendrix et al. | |

FOREIGN PATENT DOCUMENTS

| | | | |
|---|---|---|---|
| CN | 1411547 | A | 4/2003 |
| DE | 195 11 991 | A1 | 10/1996 |
| DE | 198 33 338 | A1 | 1/2000 |
| DE | 199 48 222 | A1 | 4/2001 |
| DE | 691 32 499 | T2 | 4/2001 |
| DE | 699 01 548 | T2 | 12/2002 |
| DE | 203 17 469 | U1 | 4/2004 |
| EP | 0 503 080 | B1 | 9/1992 |
| EP | 1 281 921 | A2 | 2/2003 |
| EP | 1 308 685 | A2 | 5/2003 |
| EP | 1 531 314 | B1 | 5/2005 |
| JP | 56-000993 | A | 1/1981 |
| JP | 61-175763 | U | 11/1986 |
| JP | 64-090971 | A | 4/1989 |
| JP | 01-307595 | A | 12/1989 |
| JP | 4-506996 | A | 12/1992 |
| JP | 2001-133172 | A | 5/2001 |
| WO | WO 97/23759 | A1 | 7/1997 |
| WO | WO 00/46564 | A1 | 8/2000 |
| WO | WO 01/67021 | A1 | 9/2002 |
| WO | WO 03/010482 | A1 | 2/2003 |
| WO | WO 2005/012819 | A1 | 2/2005 |

OTHER PUBLICATIONS

D. Hendrix et al., U.S. PTO Office Action, U.S. Appl. No. 10/579,037, dated Jul. 29, 2008, 9 pages.

D. Hendrix et al, U.S. PTO Office Action, U.S. Appl. No. 10/579,037, dated Jan. 23, 2009, 7 pages.

D. Hendrix et al., U.S. PTO Office Action, U.S. Appl. No. 10/579,037, dated Jul. 8, 2009, 9 pages.

D. Hendrix, U.S. PTO Notice of Allowance; U.S. Appl. No. 10/579,037, dated Jan. 11, 2010, 6 pages.

* cited by examiner

HEAT EXCHANGER, ESPECIALLY CHARGE-AIR/COOLANT RADIATOR

The invention relates to a heat exchanger, especially charge-air/coolant radiator, of disk-type construction, according to the precharacterizing clause of claim 1.

In the case of conventional charge-air/coolant radiators of disk-type construction, the charge air and the coolant are introduced into the disks via a single connecting branch in each case which has a circular cross section. A charge-air/coolant radiator of this type can still leave something to be desired in particular with regard to the cooling capacity.

It is the object of the invention to provide an improved heat exchanger.

This object is achieved by a heat exchanger with the features of claim 1. Advantageous refinements are the subject matter of the subclaims.

According to the invention, a heat exchanger, especially charge-air/coolant radiator, of disk-type construction is provided, with two adjacent disks defining an intermediate space through which a heat exchanger medium, in particular a coolant, preferably a mixture with water and glycol, or a second medium to be cooled or to be heated flows, the entry and/or exit region of the heat exchanger medium and/or second medium being expanded at least on the discharge side or inflow side. In this connection, in particular the entry and/or exit region of a fluid to be cooled, for example charge air, which forms the second medium, is of expanded design.

Instead of a charge-air/coolant radiator, use can also be made of any other desired, correspondingly constructed heat exchanger, for example an oil cooler. A heat exchanger of this type which is designed in accordance with the invention permits good distribution of the corresponding medium over the surface, which is relevant for the heat exchange, of the individual disks which form the heat exchanger. The uniform distribution of the flow reduces the boiling problems in heat exchangers used in critical regions of this type.

The region preferably runs rectilinearly at least over a third, in particular over half, of the width of the disk.

The region preferably runs at least over part of the width of the disk perpendicularly or essentially transversely, i.e. at an angle of 80° to 100°, to the average flow direction of the second medium, in particular a fluid which is to be cooled.

The opening for the second medium in an end region of the disk preferably extends essentially over the entire surface of the same, except for edge regions and regions in which passages for the heat exchanger medium are arranged.

At least two heat exchanger medium passages are preferably provided per heat exchanger medium inlet and/or outlet. A heat exchanger designed in such a manner permits good distribution of the heat exchanger medium over the surface, which is relevant for the heat exchange, of the individual disks which form the heat exchanger. The uniform distribution of the flow reduces the boiling problems in the case of heat exchangers used in critical regions of this type. In this case, the heat exchanger medium passages, in the same manner as the entry and/or exit regions of the medium to be cooled/heated, are preferably formed by apertures, in particular aligned with one another, in the individual disks.

The distribution of the heat exchanger medium is assisted by an axially symmetrical configuration of the disks with respect to their longitudinal axis with regard to the heat exchanger medium passages. If, furthermore, the disks are of axially symmetrical design with respect to their transverse axis with regard to the heat exchanger medium passages, then the installation is simplified.

A single heat exchanger medium inlet and/or a single heat exchanger medium outlet, having a branching and/or junction, is preferably provided. This permits a relatively simple construction with improved heat transfer owing to the better distribution of the flow.

The branching and/or the junction are preferably designed in the shape of an arc of a circle, with the result that a space-saving construction around the bolts or the like holding the individual disks together is possible.

A bend of 30° to 90° is preferably provided—as seen in the direction of flow—in the region of the branching and/or of the junction, with the forked part of the branching and/or junction being oriented parallel to the disks.

The heat exchanger medium inlet, which merges into two heat exchanger medium passages after the branching, preferably runs parallel to the heat exchanger medium passages while the two-part part of the branching is preferably arranged in a plane lying perpendicularly thereto. The heat exchanger medium outlet, which merges from two heat exchanger medium passages into the junction, preferably runs parallel to the heat exchanger medium passages while the two-part part of the branching is preferably arranged in a plane lying perpendicularly thereto. This permits a compact and space-saving construction of the heat exchanger. As an alternative, supply may also take place by means of two individual, separately formed pipes which are connected to each other via a Y-shaped connecting piece.

A heat exchanger of this type is preferably used as a charge-air/coolant radiator for cooling the charge air. In this connection, a mixture with water and glycol is preferably used as the heat exchanger medium (coolant).

Figure 2:
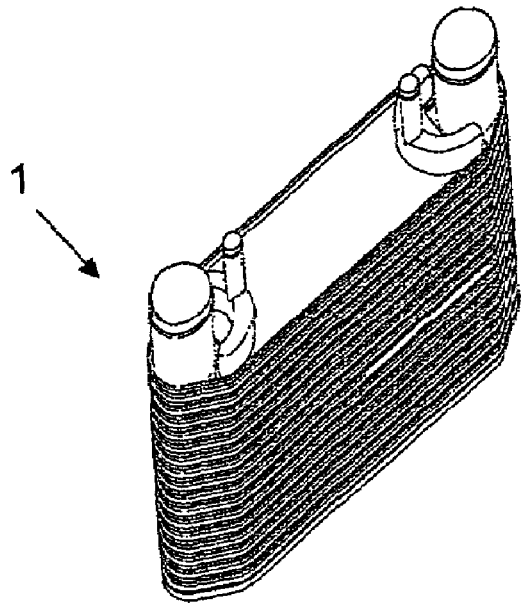
Figure 3:
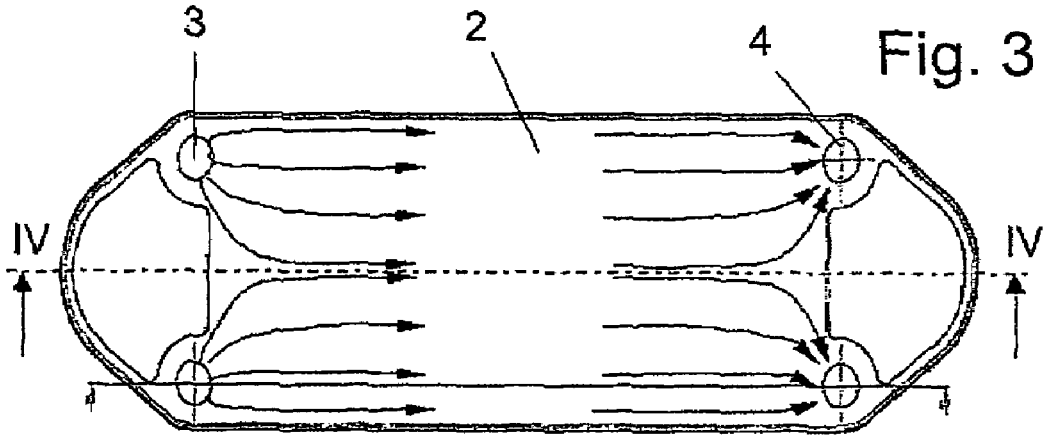
Figure 4:
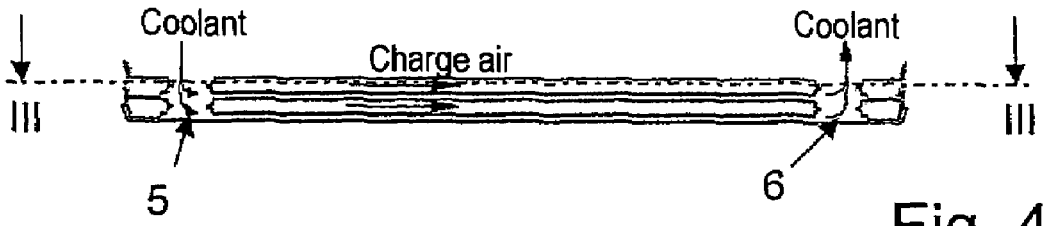
Figure 5:
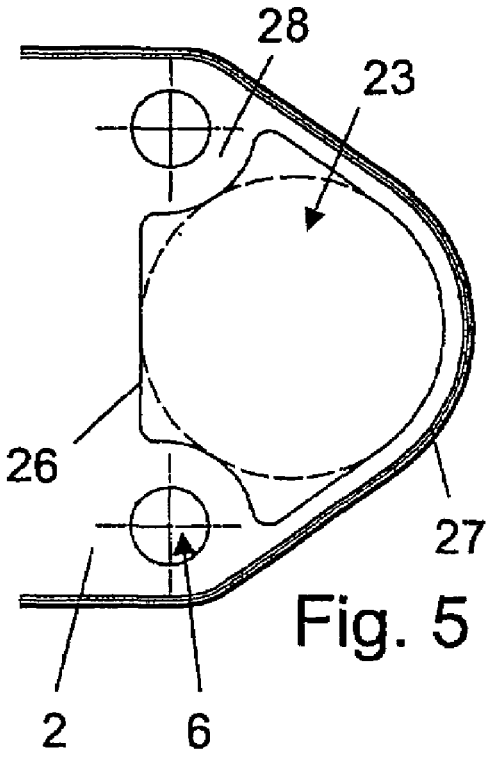
Figure 6:
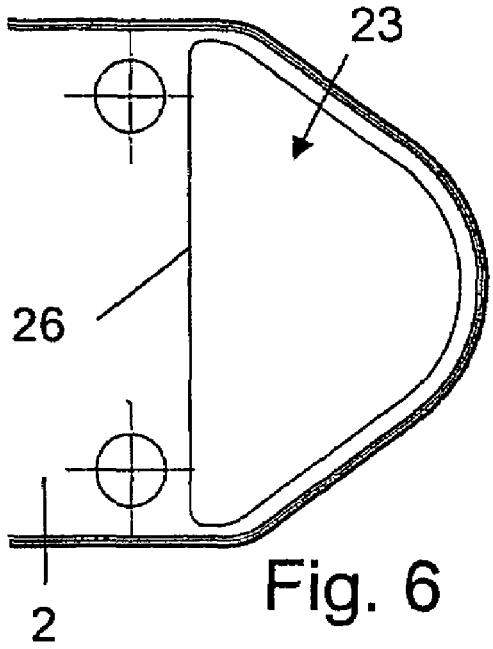
Figure 7:
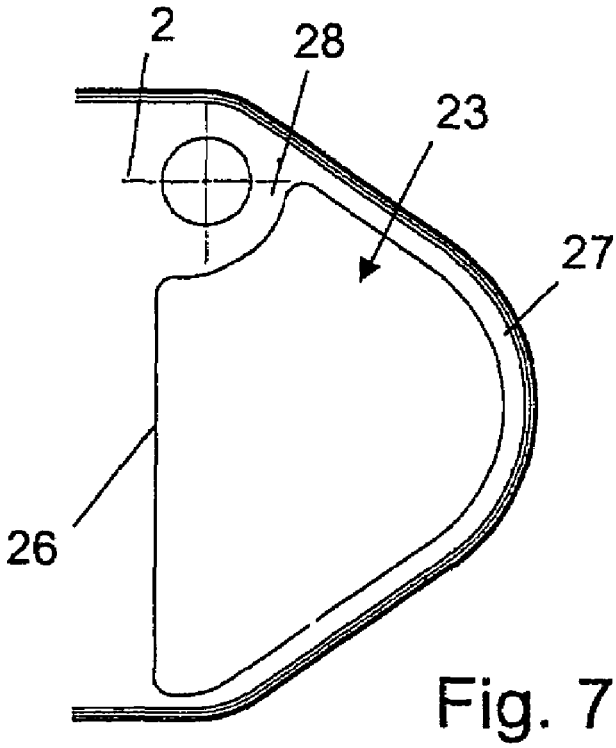

The invention is explained in detail below using three exemplary embodiments with reference to the drawing. In the drawing:

FIG. 1 shows a schematized, perspective exploded illustration of a charge-air/coolant radiator of disk-type construction according to the first exemplary embodiment, FIG. 2 shows a perspective illustration of the charge-air/coolant radiator of FIG. 1, FIG. 3 shows a section through the charge-air/coolant radiator of FIG. 1 along line III-III in FIG. 4, FIG. 4 shows a section through the charge-air/coolant radiator of FIG. 1 along line IV-IV in FIG. 3, FIG. 5 shows an enlarged detail of a coolant disk, FIG. 6 shows an enlarged detail of a coolant disk according to a second exemplary embodiment, and FIG. 7 shows an enlarged detail of a coolant disk according to a third exemplary embodiment.

A charge-air/coolant radiator 1 used as a heat exchanger between charge air and coolant has a plurality of coolant disks 2 stacked on one another. In this case, two inlet openings 3 and two outlet openings 4 are provided in each coolant disk 2, through which openings coolant, as the heat exchanger medium, is supplied to or removed from the intermediate spaces of the coolant disks 2. The direction of flow is indicated in the figures by arrows. The coolant spreads here after being inlet through the inlet openings 3 over the entire width of the intermediate spaces of the coolant disks 2 and flows uniformly in the direction of the outlet openings 4 (see FIG. 3), so that the entire length and width of the intermediate spaces between the inlet and outlet openings 3 and 4 have the flow passing uniformly through them, and an optimum transfer of heat from the charge air which is to be cooled and which flows between the individual coolant disks 2 through the charge-air/coolant radiator 1 can take place.

The openings 3 and 4 of the coolant disks 2 which are stacked on one another form coolant passages 5 and 6. For this, the regions of the openings 3 and 4 are of correspondingly raised design, so that there is sufficient intermediate space for the charge air to be able to flow between the coolant disks 2 and be cooled.

The two coolant passages 5 begin—as seen in the direction of flow of the coolant—at a branching 7 which has a forking 8 in the shape of an arc of a circle and has a coolant inlet 9 which is arranged centrally in the arc of the circle of the same and is arranged parallel to the coolant passages 5. The coolant supplied through the coolant inlet 9 is thus divided uniformly between the two coolant passages 5.

The outlet is of corresponding design to the inlet. The two coolant passages 6 thus end with a junction 10 which is of corresponding design to the branching 7 and has a coolant outlet 11.

The charge air (second medium) is supplied via a charge-air inlet 20, and then is supplied via a charge-air passage 21, which is formed by openings 22 in the coolant disks 2 stacked on one another, to the intermediate spaces between the intermediate spaces, through which the coolant flows, of the coolant disks 2 and passes via openings 23, which are formed on the other side of the coolant disks 2 and form a second charge-air passage 24, to the charge-air outlet 25.

Unlike in the prior art (illustrated by dashed lines in FIG. 5), the openings 22 and 23 are not circular but rather have a region 26 which, according to the first exemplary embodiment, runs essentially rectilinearly, with it being arranged perpendicularly to the normal direction of flow of the charge air, so that, in this region 26, it is arranged tangentially with respect to the conventional shape which corresponds to the inner circle of the openings 22 and 23.

The openings 22 and 23 each take up the entire end region of the coolant disk 2, apart from an outer edge 27, the two coolant passages 5 and 6 and an edge 28 in each case surrounding the coolant passages.

According to a second exemplary embodiment which is illustrated in FIG. 6, the region 26 of the opening 23 is designed in such a manner that it extends over the entire end region of the coolant disks 2, with it being arranged perpendicularly to the average direction of flow of the charge air. In this case, the coolant passages are offset further inward, thus producing the shape of a rounded triangle. The other side of the coolant disk 2 is of corresponding design.

According to a third exemplary embodiment illustrated in FIG. 7, the opening 23 corresponds approximately to the opening 23 of the second exemplary embodiment, with just one coolant passage being provided which is displaced laterally into the region of the opening 23, so that the opening 23 takes up the end region of the coolant disk 2, apart from an outer edge 27, the coolant passage and an edge 28 surrounding the coolant passage. The other side of the coolant disk 2 is of corresponding design, in particular is axially symmetrical to the central transverse axis or is point-symmetrical with respect to the central point of the coolant disk.

LIST OF REFERENCE NUMBERS

1 Charge-air/coolant radiator
2 Coolant disk
3 Inlet opening
4 Outlet opening
5 Coolant passage
6 Coolant passage
7 Branching
8 Fork
9 Coolant inlet
10 Junction
11 Coolant outlet
20 Charge-air inlet
21 Charge-air passage
22 Opening
23 Opening
24 Second charge-air passage
25 Charge-air outlet
26 Region
27 Outer edge
28 Edge

The invention claimed is:

1. A heat exchanger, comprising:

a plurality disks, wherein the plurality of disks includes at least two adjacent disks defining an intermediate space through which a heat exchanger medium or a second medium to be cooled or to be heated can flow, wherein an opening for the second medium is located in an end region of the disks, wherein the opening for the second medium extends essentially over an entire surface of the end region, except for edge regions and regions of the disks in which passages are arranged, wherein heat exchanger medium passages are located in the end region of the disks so that the heat exchanger medium passages are offset in an axial direction of the disks from the opening for the second medium and are located further inward from an end of the disks than the opening for the second medium, wherein at least a portion of the heat exchanger medium passages is located behind at least a portion of the opening for the second medium when a respective disk is viewed in a plane of the respective disk along a longitudinal axis of the respective disk and in a direction extending from an end of the disk where the end region is located to an opposite end of the respective disk, wherein at least another portion of the opening for the second medium is located behind at least another portion of at least one of the heat exchanger medium passages when the respective disk is viewed in the plane of the respective disk in a direction perpendicular to the direction extending from an end of the disk where the end region is located to an opposite end of the respective disk.

2. The heat exchanger as claimed in claim 1, wherein the end region runs rectilinearly at least over a third of a width of at least one of the plurality of disks.

3. The heat exchanger as claimed in claim 2, wherein the region runs rectilinearly at least over a half of the width of one of the plurality of disks.

4. The heat exchanger as claimed in claim 1, wherein the region runs at least over part of a width of the disk perpendicularly or essentially transversely to an average flow direction of the second medium.

5. The heat exchanger as claimed in claim 1, wherein a common heat exchanger medium inlet and heat exchanger medium outlet are provided for the disks, wherein the heat exchanger medium passage comprise at least two heat exchanger medium passages for each heat exchanger medium inlet and/or outlet.

6. The heat exchanger as claimed in claim 5, wherein the disks are of axially symmetrical design with respect to their longitudinal axis and with regard to the heat exchanger medium passages.

7. The heat exchanger as claimed in claim 5, wherein the disks are of axially symmetrical design with respect to their transverse axis and with regard to the heat exchanger medium passages.

8. The heat exchanger as claimed in claim 1, wherein a heat exchanger medium inlet and/or a heat exchanger medium outlet has a branching and/or junction.

9. The heat exchanger as claimed in claim 8, wherein the branching and/or junction is designed in a shape of an arc of a circle.

10. The heat exchanger as claimed in claim 8, wherein a bend of 30° to 90° is provided, as seen in a direction of flow, in an area of the branching and/or of the junction.

11. The heat exchanger as claimed in claim 8, wherein the heat exchanger medium inlet, which merges into two heat exchanger medium passages after the branching, runs parallel to the heat exchanger medium passages while a two-part part of the branching is arranged in a plane lying perpendicularly thereto.

12. The heat exchanger as claimed in claim 8, wherein the heat exchanger medium outlet, which merges from two heat exchanger medium passages into the junction, runs parallel to the heat exchanger medium passages while a two-part part of the branching is arranged in a plane lying perpendicularly thereto.

13. The heat exchanger as claimed in claim 1, wherein the heat exchanger is a charge-air/coolant radiator or oil cooler.

14. The heat exchanger as claimed in claim 1, wherein the disks are of axially symmetrical design with respect to their transverse axis and with regard to the heat exchanger medium passages and the opening for the second medium.

15. The heat exchanger as claimed in claim 1, wherein an entry and/or exit region for the heat exchanger medium and/or second medium is expanded at least on a discharge side or inflow side of a radiator.

* * * * *